US012312706B2

(12) United States Patent
Berman et al.

(10) Patent No.: US 12,312,706 B2
(45) Date of Patent: May 27, 2025

(54) COATINGS THAT REDUCE FRICTION AND WEAR

(71) Applicant: University of North Texas, Denton, TX (US)

(72) Inventors: Diana Berman, Denton, TX (US); Asghar Shirani, Denton, TX (US)

(73) Assignee: University of North Texas, Denton, TX (US)

( * ) Notice: Subject to any disclaimer, the term of this patent is extended or adjusted under 35 U.S.C. 154(b) by 0 days.

(21) Appl. No.: 18/545,198

(22) Filed: Dec. 19, 2023

(65) Prior Publication Data

US 2024/0209274 A1 Jun. 27, 2024

Related U.S. Application Data

(60) Provisional application No. 63/434,211, filed on Dec. 21, 2022.

(51) Int. Cl.

| | |
|---|---|
| ***C25D 9/10*** | (2006.01) |
| ***C10M 177/00*** | (2006.01) |
| ***C10N 50/00*** | (2006.01) |
| ***C10N 70/00*** | (2006.01) |
| ***C25D 3/56*** | (2006.01) |

(52) U.S. Cl.

CPC ..... *C25D 9/10* (2013.01); *C10M 177/00* (2013.01); *C25D 3/562* (2013.01); *C10M 2201/0603* (2013.01); *C10M 2203/022* (2013.01); *C10M 2207/0215* (2013.01); *C10N 2050/023* (2020.05); *C10N 2070/00* (2013.01)

(58) Field of Classification Search

CPC ..... C10M 177/00; C10M 2201/0603; C10M 2203/022; C10M 2207/0215; C10N 2050/023; C10N 2070/00; C25D 3/562; C25D 9/10

See application file for complete search history.

(56) References Cited

U.S. PATENT DOCUMENTS 6,355,154 B1 * 3/2002 Buratti ..... B31F 1/2863 205/206
2017/0002473 A1 * 1/2017 Trejo-Córdova ..... C25D 3/46

FOREIGN PATENT DOCUMENTS

KR 20060025500 A * 3/2006

OTHER PUBLICATIONS

English-language machine translation of KR20060025500A (Year: 2006).*

* cited by examiner

*Primary Examiner* — James C Goloboy
(74) *Attorney, Agent, or Firm* — Thomas | Horstemeyer LLP.

(57) ABSTRACT

The present disclosure provide for coatings, coated structures, methods of coating, methods of coating a structure, and the like. In an aspect, the coating is a tribocatalytically-active coating, where the tribocatalytically-active coating interacts with the hydrocarbon environment forming a protective carbon-based tribofilm on the surface of the coating, which can be actively formed (reformed) during use of the coated structure within the hydrocarbon environment.

19 Claims, 5 Drawing Sheets

Fig. 1A
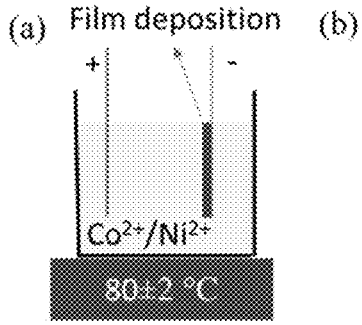
Fig. 1B
(b)
| | $NiCl_2$ (g/l) | Ni (wt.%) | P (wt.%) |
|---|---|---|---|
| CoP | 0 | 0 | 14.3 |
| Co3NiP | 5 | 3.3 | 14.8 |
| Co5NiP | 10 | 5.2 | 11.8 |
| Co8NiP | 20 | 8.1 | 11.2 |
| Co14NiP | 30 | 13.8 | 11.5 |
Fig. 1C
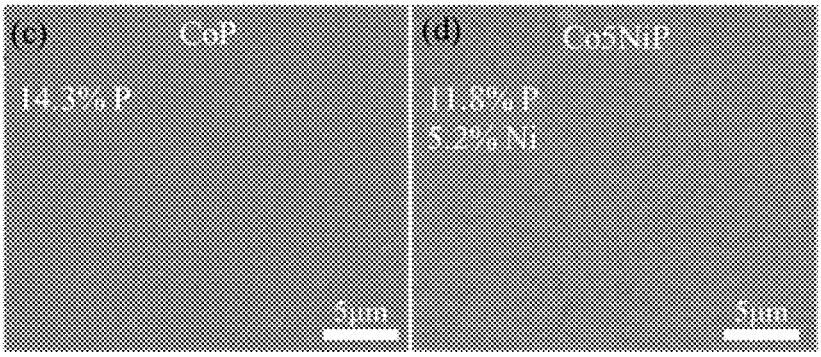
Fig. 1D
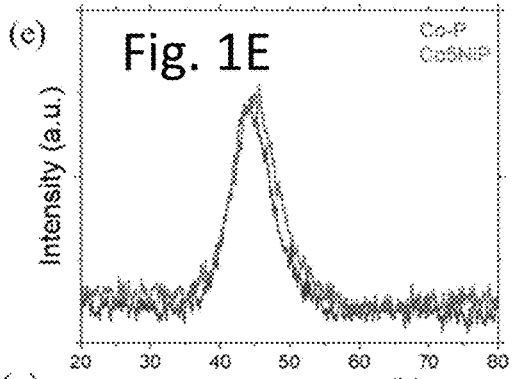
Fig. 1E
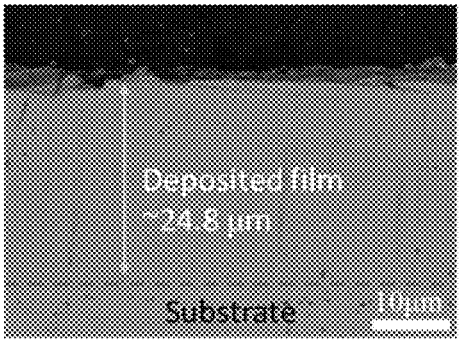
Fig. 1F
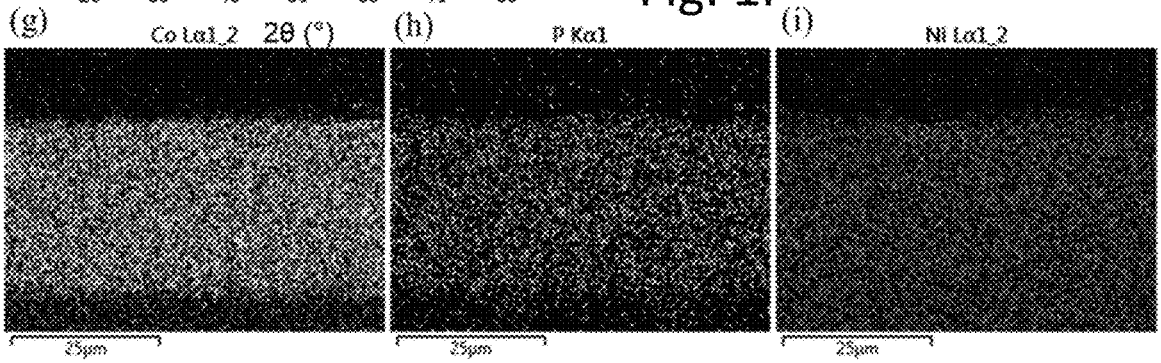
Fig. 1G Fig. 1H Fig. 1I Fig. 2A
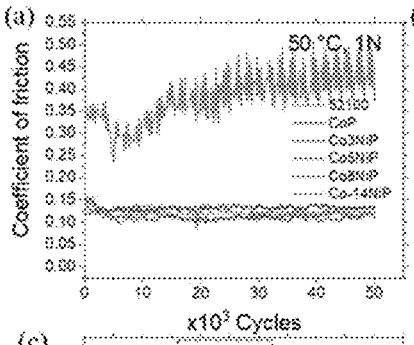
Fig. 2B
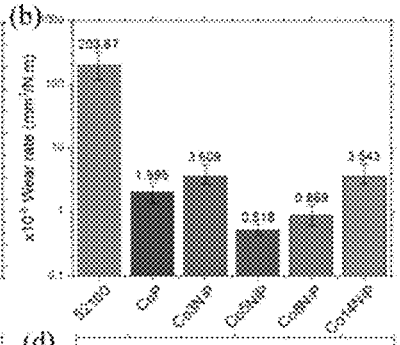
Fig. 2C
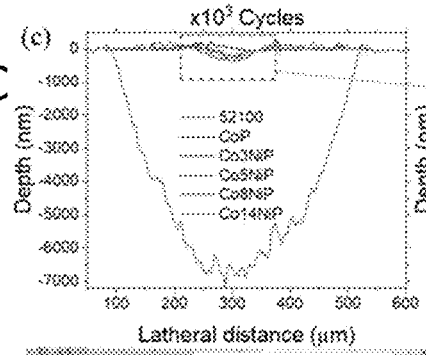
Fig. 2D
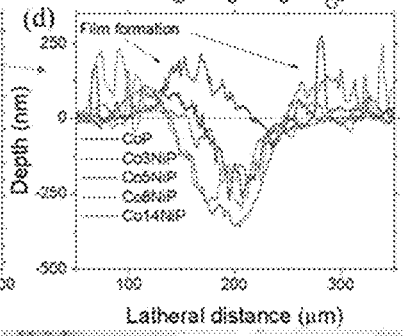
Fig. 2E
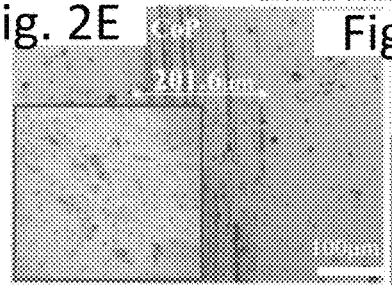
Fig. 2F
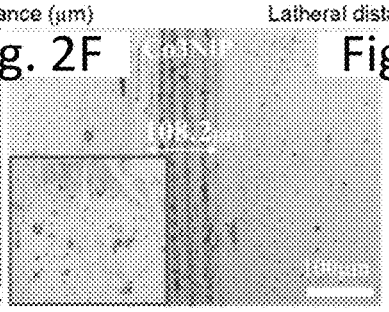
Fig. 2G
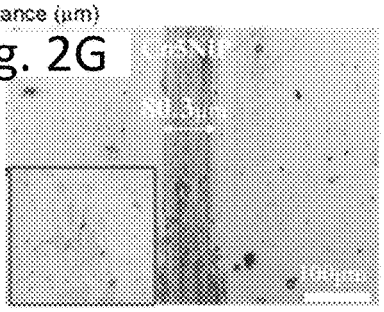
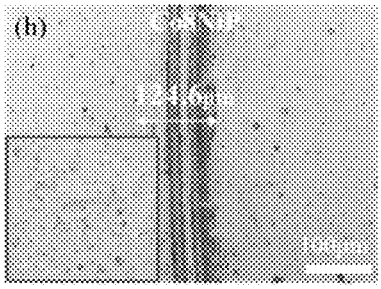
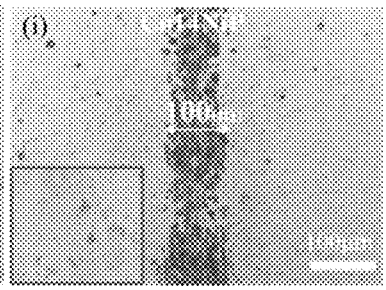
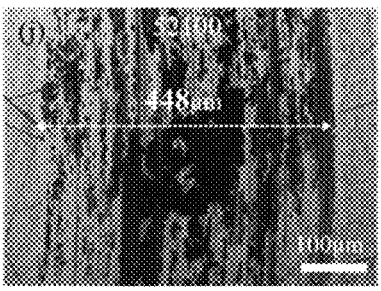
Fig. 2H
Fig. 2I
Fig. 2J Fig. 3A
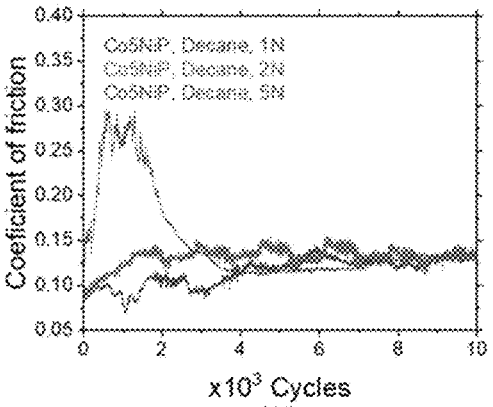
Fig. 3B
Fig. 3D
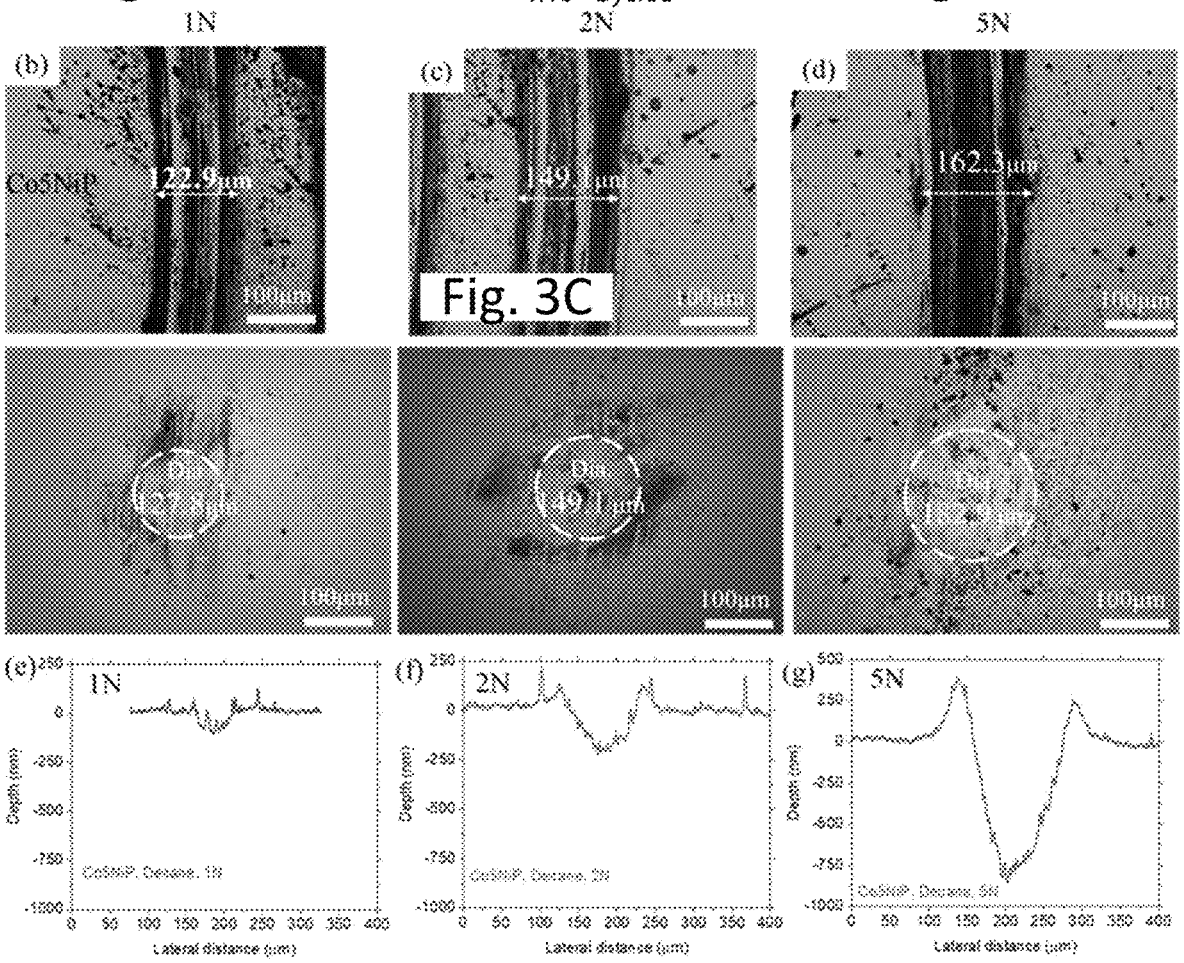
Fig. 3E
Fig. 3F
Fig. 3G Fig. 4A
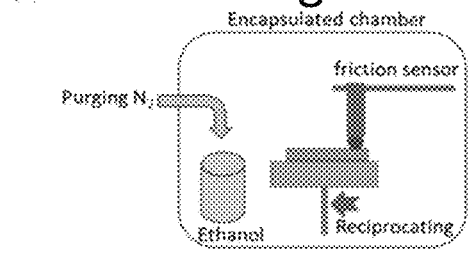
Fig. 4B
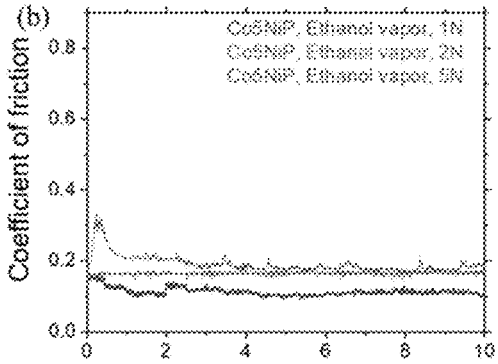
Fig. 4C 1N Fig. 4D 2N 5N Fig. 4E
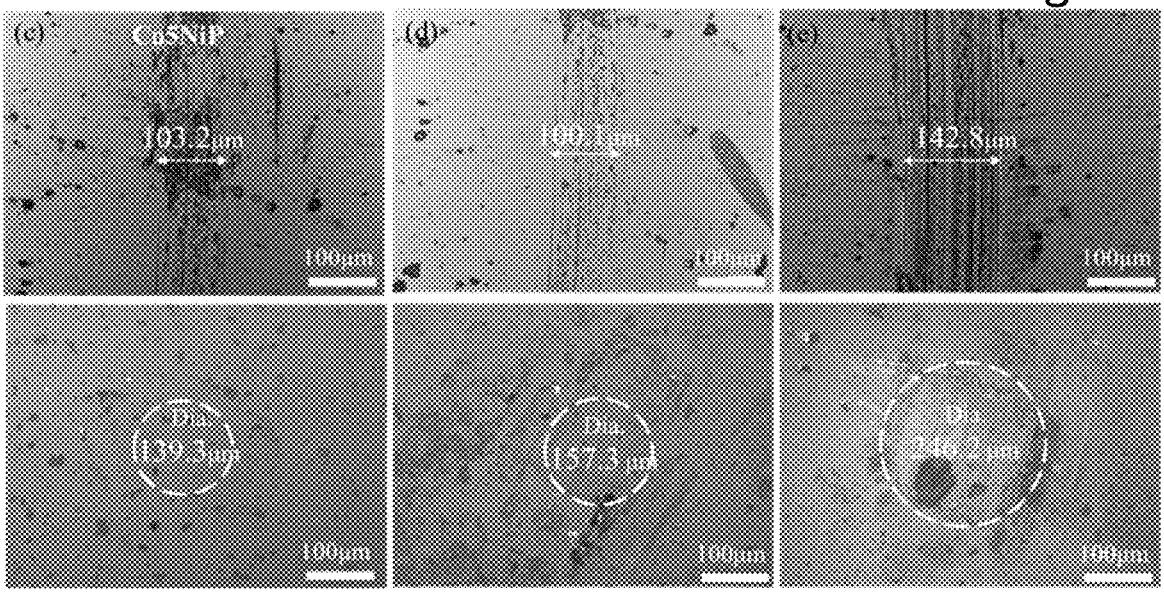
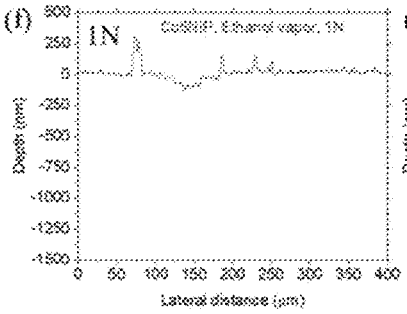
Fig. 4F
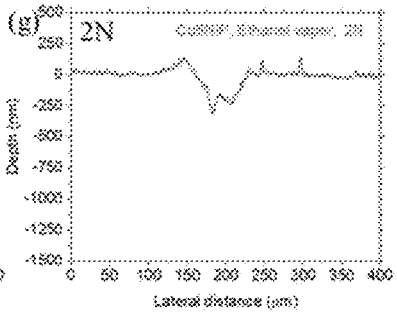
Fig. 4G
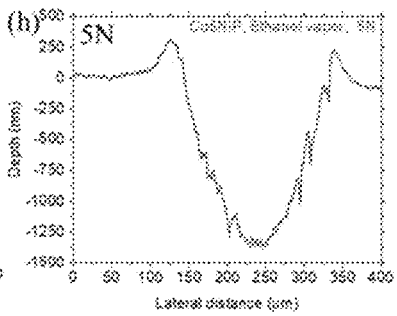
Fig. 4H Fig. 5A
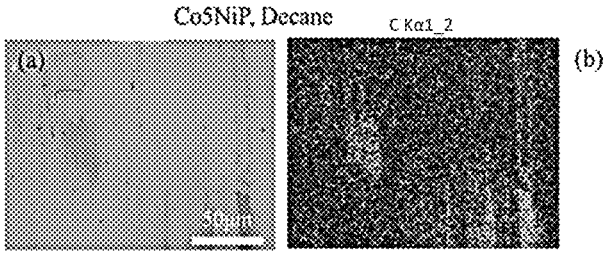
Fig. 5B
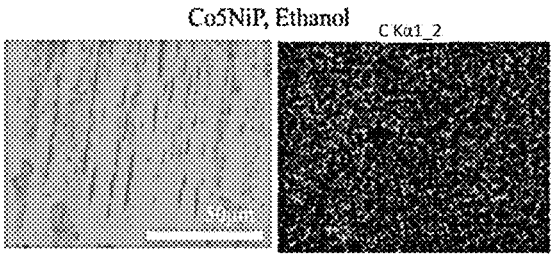
Fig. 5C
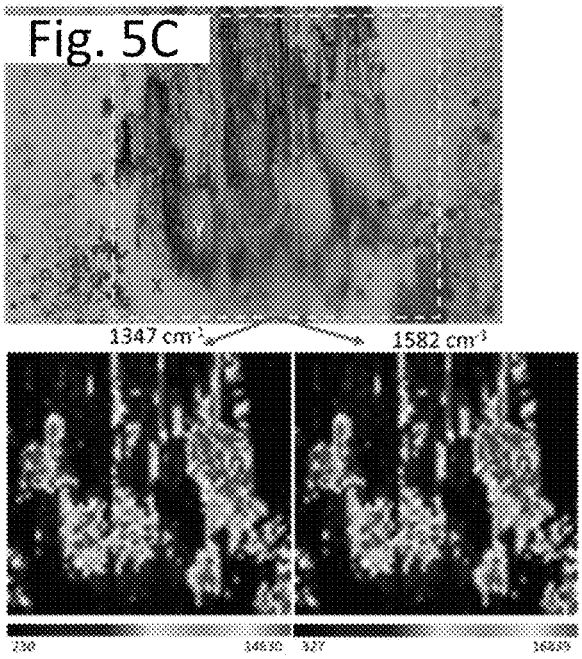
Fig. 5D
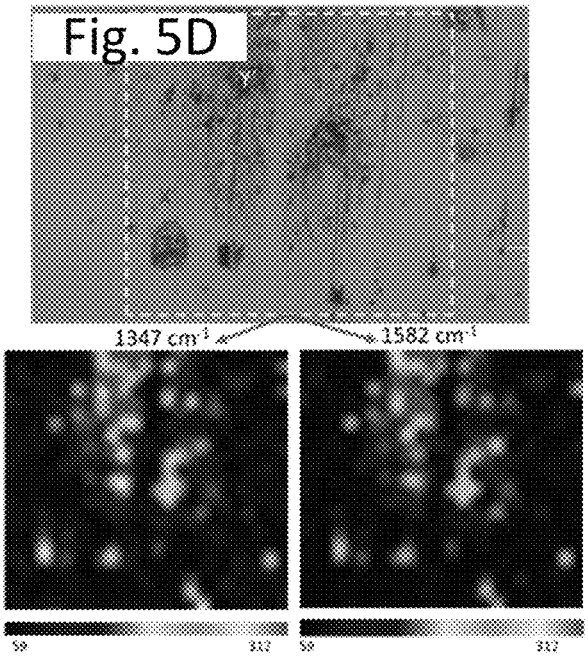
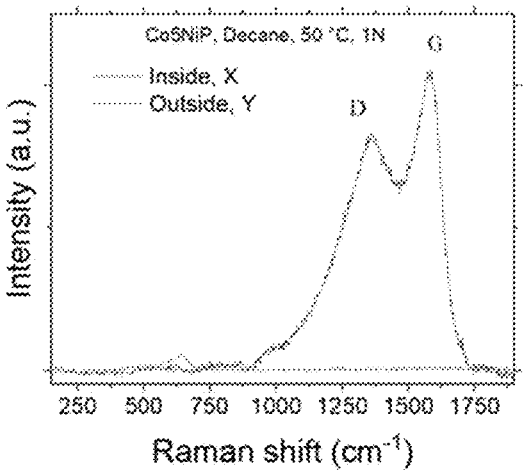
Fig. 5E
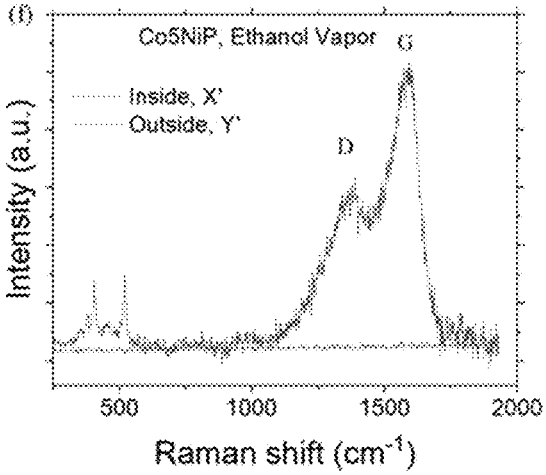
Fig. 5F

COATINGS THAT REDUCE FRICTION AND WEAR

CROSS REFERENCE TO RELATED APPLICATIONS

This application claims the benefit of U.S. Provisional Application No. 63/434,211 entitled "COATINGS THAT REDUCE FRICTION AND WEAR" and filed on Dec. 21, 2022, which is incorporated herein by reference in its entirety.

STATEMENT REGARDING FEDERALLY SPONSORED RESEARCH OR DEVELOPMENT

This invention was made with government support under Award No. 2018132 awarded by the National Science Foundation. The government has certain rights to the invention.

BACKGROUND

Degradation of surface reduce the usefulness of mechanical systems, most of which is due to mechanically induced wear and deformation of materials. In an effort to address these issues, surfaces can be covered with a film, but these films wear away and replacing or replenishing the film can be challenging. High contact pressure and shear during relative movement of the sliding interfaces provides other challenges to degradation of surfaces. Solutions are needed to address these challenges.

SUMMARY

The present disclosure provides for for coatings, coated structures, methods of coating, methods of coating a structure, and the like.

In an aspect, the present disclosure provides for a coated structure, comprising a surface of the structure having a tribocatalytically-active coating disposed on the surface, wherein the tribocatalytically-active coating comprises a matrix having at least one type of catalytically active element, wherein the matrix is a CoP matrix or a NiP matrix, wherein the catalytically active element is a nanoparticle having a longest dimension of about 3 to 10 nanometers. The type of catalytically active element can be selected from Ni, Cu, Ir, Pt, Pd, Ru, and Mo. The catalytically active element can be about 5 to 30 weight percent of the tribocatalytically-active coating. The structure can be made of steel, copper, aluminum, stainless steel, or bronze. The tribocatalytically-active coating can have a thickness of about 1 to 25 micrometers.

In an aspect, the present disclosure provides for a method of making the coated structure of as described above and herein, comprising: introducing an uncoated structure having a surface to an electrolyte including a mixture of metal-based material, a phosphorous based-material, and a catalytically active element based-material, wherein the metal-based material is a cobalt-based material or a nickel-based material; and forming a tribocatalytically-active coating on the surface by electrodeposition of the mixture, wherein the tribocatalytically-active coating comprises a matrix having at least one type of catalytically active element, wherein the matrix is a CoP matrix or a NiP matrix, wherein the catalytically active element is a nanoparticle having a longest dimension of about 3 to 10 nanometers. When the matrix is a CoP matrix, the metal-based material is a cobalt-based material selected from $CoCl_2$ or $CoSO_4$, and wherein the phosphorous-based material is $H_3PO_4$ or $NaH_2PO_2$. When the matrix is a NiP matrix, the metal-based material is a nickel-based material selected from $NiCl_2$ or $NiSO_4$, and wherein the phosphorous-based material is $H_3PO_4$ or $NaH_2PO_2$. The catalytically active element can be about 5 to 30 weight percent of the tribocatalytically-active coating. The structure can be made of steel, copper, aluminum, stainless steel, or bronze.

BRIEF DESCRIPTION OF THE DRAWINGS

Further aspects of the present disclosure will be more readily appreciated upon review of the detailed description of its various embodiments, described below, when taken in conjunction with the accompanying drawings. The components in the drawings are not necessarily to scale, emphasis instead being placed upon clearly illustrating the principles of the present disclosure. Moreover, in the drawings, like reference numerals designate corresponding parts throughout the several views.

FIG. 1*a* illustrates a schematic of CoP, CoNiP electrodeposition. FIG. 1*b* provides a summary of the resulting composition of the coatings. Surface texture (FIG. 1*c*) CoP and (FIG. 1*d*) $Co_5NiP$. XRD of the deposited film (FIG. 1*e*). Micro-cross section of the CoP film shows the film's thickness (FIG. 1*f*) and the uniform distribution of (FIG. 1*g*) Co, (FIG. 1*h*) Ni, and (FIG. 1*i*) P within the film's thickness.

FIG. 2*a* illustrates the coefficient of friction and wear analysis of the CoP coatings with 3, 5, 8, and 14 wt % of nickel at 50° C. In contrast to the uncoated 52100 steel, significant improvements in both the COF and wear are demonstrated. FIG. 2*b* shows the calculated wear rate for the 52100 and coatings. FIG. 2*c* and 2*d* illustrate the stylus profilometry results for the wear track profiles captured at the center of the wear tracks. FIGS. 2*e*-2*j* illustrate the optical micrographs of the wear tracks formed on CoP with 0 (FIG. 2*e*), 3 (FIG. 2*f*), 5 (FIG. 2*g*), 8 (FIG. 2*h*), 14% Ni (FIG. 2*i*), and on the uncoated 52100 steel (FIG. 2*j*) respectively.

FIG. 3*a* illustrates the coefficient of friction of $Co_5NiP$ as a function of load upon sliding in decane at 25° C. FIG. 3*b*-*d* illustrates the optical micrographs of the wear tracks and counter-body after the testing in decane. FIG. 3*e*-*g* illustrate the profilometry analysis of the wear tracks formed during testing of the coated sample. Significant improvements in the wear resistance of materials are observed. This improvement is more pronounced for lower loads.

FIG. 4*a* illustrates a schematic of the tribology set-up used for Ni/Ethanol vapor tests at 25° C. FIG. 4*b* illustrates the coefficient of friction for the $Co_5NiP$ coating as a function of load under exposure to ethanol vapor. FIG. 4*c*-*e* illustrate optical micrographs of the wear tracks and counter-body after testing in ethanol vapor. FIG. 4*f*-*h* illustrate the profilometry analysis of the wear tracks formed during testing. $Co_5NiP$ provides good protection in a carbon-rich gaseous environment.

FIG. 5*a*-*f* illustrate SEM and Raman analysis indicate the formation of carbon-rich tribofilms inside the wear track. FIGS. 5*a* and 5*b* illustrate EDS mapping of the wear track tested in decane and ethanol vapor for $Co_5NiP$ coatings, respectively. FIGS. 5*c* and 5*d* illustrate optical micrographs showing the area for which the 2D-Raman spectroscopy was acquired for decane and ethanol vapor media, respectively. Single spectra of the selected points are noted with X, and Y for decane and ethanol vapor, respectively (FIGS. 5*e* and 5*f*).

DETAILED DESCRIPTION

The present disclosure provide for coatings, coated structures, methods of coating, methods of coating a structure, and the like. In an aspect, the coating is a tribocatalytically-active coating, where the tribocatalytically-active coating interacts with the hydrocarbon environment forming a protective carbon-based tribofilm on the surface of the coating, which can be actively formed (reformed) during use of the coated structure within the hydrocarbon environment.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, material science, tribology, and the like, which are within the skill of the art.

The following examples are put forth so as to provide those of ordinary skill in the art with a complete disclosure and description of how to perform the methods and use the compositions, methods, and materials disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise.

As used herein, the following terms have the meanings ascribed to them unless specified otherwise. In this disclosure, "consisting essentially of" or "consists essentially" or the like, when applied to methods and compositions encompassed by the present disclosure refers to compositions like those disclosed herein, but which may contain additional structural groups, composition components or method steps (or analogs or derivatives thereof as discussed above). Such additional structural groups, composition components or method steps, etc., however, do not materially affect the basic and novel characteristic(s) of the compositions or methods, compared to those of the corresponding compositions or methods disclosed herein. "Consisting essentially of" or "consists essentially" or the like, when applied to methods and compositions encompassed by the present disclosure have the meaning ascribed in U.S. Patent law and the term is open-ended, allowing for the presence of more than that which is recited so long as basic or novel characteristics of that which is recited is not changed by the presence of more than that which is recited, but excludes prior art embodiments.

DISCUSSION

Embodiments of the present disclosure provide for coatings, coated structures, methods of coating, methods of coating a structure, and the like. In an aspect, the coating is a tribocatalytically-active coating, where the tribocatalytically-active coating interacts with the hydrocarbon environment forming a protective carbon-based tribofilm on the surface of the coating, which can be actively formed (reformed) during use of the coated structure within the hydrocarbon environment.

High-contact pressure and shear during relative movement of the sliding interfaces provide the unique capability for local heating and shear- and load-induced compression of the sliding surfaces. These conditions may induce tribochemical reactions that lead to the formation of a protective damage-suppressing tribofilm directly at the contact area of the sliding surfaces. Aspects of the present disclosure provide for a tribocatalytically-active coatings that demonstrate excellent tribological performance in hydrocarbon-rich environments, such as a liquid and/or a gaseous hydrocarbon environment. The tribochemical reaction of a catalytically active element in the tribocatalytically-active coating with the hydrocarbon forms a protective carbon-based tribofilm on the surface of the coating during sliding. The tribocatalytically-active coating can be quickly and inexpensively formed using electrodeposition processes.

The present disclosure provides for coated structure having a tribocatalytically-active coating disposed on the surface of the structure. The structure can be any metal surface and some examples include: steel, stainless steel, copper, aluminum, or a combination thereof. The structure can be a component that when used is subject to high-contact pressure and/or shear. In an aspect, the structure is used in a hydrocarbon-rich environment, such as a liquid and/or a gaseous hydrocarbon environment, where the tribocatalytically-active coating comes into contact with the liquid and/or a gaseous hydrocarbon. For example, the structure can one that is used combustion engines, fuel pumps, seals, and gear boxes. In particular, the structure can be include those that come into contact with the hydrocarbon source (e.g, in form of oil, alcohol, solvents, organic vapors, and the like) and some examples include: cam, crankshaft, and pistons.

In an aspect, the tribocatalytically-active coating includes a matrix having at least one type of catalytically active element. The matrix can be a CoP matrix or a NiP matrix. The type of catalytically active element can be selected from Ni, Cu, Ir, Pt, Pd, Co, Fe, Mo or their mixtures. In an aspect, the matrix is a CoP matrix and the catalytically active element can be selected from Ni, Cu, Ir, Pt, Pd, Co, Fe, Mo or their mixtures and in particular the catalytically active element is Ni. In an aspect the matrix can be a NiP matrix and the catalytically active element can be selected from Cu, Ir, Pt, Pd, Co, Fe, Mo or their mixtures.

The three-dimensional geometric shape of the catalytically active element nanoparticles can be spherical, substantially spherical, polygonal, or the like. The catalytically active element can be a nanoparticle having a longest dimension (e.g., diameter) of about 3 to 10 nanometers or 3 to 7 nanometers, or 3 to 5 nanometers.

In an aspect, the catalytically active element can be about 5 to 30 weight percent, about 5 to 25 weight percent, about 5 to 20 weight percent, about 5 to 15 weight percent, about 5 to 10 weight percent, about 7 to 12 weight percent of the tribocatalytically-active coating.

In an aspect, the tribocatalytically-active coating can have a thickness of about 1 to 25 micrometers, about 1 to 20 micrometers, about 1 to 15 micrometers, about 1 to 20 micrometers, about 5 to 25 micrometers, about 5 to 20 micrometers, or about 5 to 15 micrometers.

In an aspect, the surface of the structure having the tribocatalytically-active coating can have a Coefficient of friction of about 0.10 to 0.15 in Decane and 0.1-0.2 in Ethanol vapor.

In an aspect, the surface of the structure having the tribocatalytically-active coating can have a wear resistance of two orders of magnitude lower compared to a structure that does not include tribocatalytically-active coating against steel sliding (e.g., about $1.02\times10^{-3}$ to $5.443\times10^{-6}$ $mm^3/N\cdot m$.).

Exemplary embodiment of the present disclosure includes a coated substrate where the structure is made of steel or stainless steel, where the tribocatalytically-active coating includes the CoP matrix and the catalytically active element is Ni having a longest dimension of about 3 to 5 nanometers and the Ni is about 5 to 15 weight percent of the tribocatalytically-active coating. The coating is about 1 to 10 micrometers thick.

Exemplary embodiment of the present disclosure includes a coated substrate where the structure is made of copper, where the tribocatalytically-active coating includes the CoP matrix and the catalytically active element is Ni having a longest dimension of about 3 to 5 nanometers and the Ni is about 5 to 15 weight percent of the tribocatalytically-active coating. The coating is about 1 to 10 micrometers thick.

Exemplary embodiment of the present disclosure includes a coated substrate where the structure is made of aluminum, where the tribocatalytically-active coating includes the CoP matrix and the catalytically active element is Ni having a longest dimension of about 3 to 5 nanometers and the Ni is about 5 to 15 weight percent of the tribocatalytically-active coating. The coating is about 1 to 10 micrometers thick.

In addition, the present disclosure provides for methods for making the coated structure having a tribocatalytically-active coating disposed on the surface of the structure. In an aspect, the method of making the coating structure includes introducing an uncoated structure (e.g., steel, stainless steel, copper, aluminum, and the like) having a surface to an electrolyte including a mixture of metal-based material, a phosphorous based material, and a catalytically active element-based material. The metal-based material is a cobalt-based material (e.g., $CoCl_2$, $CoSO_4$) or a nickel-based material (e.g., $NiCl_2$). The concentration of the metal-based material can be about 150 to 300 g/l or 200 to 220. The phosphorous based material can be $H_3PO_4$, or $NaH_2PO_2$. The concentration of the phosphorous based material can be about 10 to 80 g/l for $H_3PO_3$ and 5 to 40 g/l for $NaH_2PO_2$. The catalytically active element-based material can be a Ni catalytically active element-based material (e.g., CoNiP, NiP, or CuNiP), Cu catalytically active element-based material (e.g., CoCuP, or CuP), Ir catalytically active element-based material (e.g., CoIrP, NiIrP, or CuIrP), Pt catalytically active element-based material (e.g., CoPtP, NiPtP, or CuPtP), Pd catalytically active element-based material (e.g., CoPdP, NiPdP, or CuPdP) Ru catlytically active element-base (e.g., CoRuP, NiRuP, or CuRuP), Fe cathalytically active element-based (e.g., CoFeP, NiFeP, or CuFeP) and Mo cathalytically active element-based (e.g., CoMoP, NiMoP, or CuMoP). The concentration of the catalytically active element-based material can be about 1 to 50 or 3 to 20.

The tribocatalytically-active coating can be formed on the surface by electrodeposition of the mixture under condition of 100 $mA/cm^2$ current density, 80° C., 0-1 pH. Additional details are provided in the Example.

In a particular aspect, high-contact stresses during relative movement of the sliding interfaces provide the unique capability for local heating and shear- and load-induced compression of the surfaces in contact. These conditions, when involving sliding of a correct combination of materials, may facilitate tribochemical reactions that lead to the formation of a protective damage-suppressing tribofilm directly at the contact. The present disclosure provides for designing via electrodeposition a coating composed of a hard cobalt-phosphorous matrix with the inclusion of tribocatalytically-active nickel. The coating can be optimized in terms of its relative composition. It has been demonstrated that excellent tribological performance of the coating in presence of a hydrocarbon environment, both in the form of a liquid lubricant or as a vapor, can be obtained. The characterization of the wear track indicates that the origin of such a performance is the formation of protective carbon-based tribofilm on the surface of the coating during sliding. The results create new knowledge on the material transformations in the contact, thus offering a new process for addressing tribological challenges in mechanical systems.

EXAMPLE

While embodiments of the present disclosure are described in connection with the Examples and the corresponding text and figures, there is no intent to limit the disclosure to the embodiments in these descriptions. On the contrary, the intent is to cover all alternatives, modifications, and equivalents included within the spirit and scope of embodiments of the present disclosure.

Example

Surface degradation accounts for more than 70% of causes for the loss of usefulness of mechanical systems [1, 2]. Out of this, 50% is attributed to mechanically induced wear and deformation of materials [3, 4]. To address this issue, surfaces are covered with protective films [5, 6]. Those films, however, eventually wear and their replenishment becomes a great challenge, as deposition of the coatings usually requires high temperature/high vacuum processing conditions not suitable for large components in need of protection.

Meanwhile, high contact pressure and shear during relative movement of the sliding interfaces provide the unique capability of local heating and shear- and load-induced compression of the sliding surfaces [7, 8]. For a correct combination of materials in sliding contact, these conditions may induce tribochemical reactions that lead to the formation of a protective damage-suppressing tribofilm directly at contact [8-10]. One of the most interesting and intriguing combinations is when carbon-based materials or composites are in close proximity to catalytically active metals.

Our prior studies demonstrated that the tribological characteristics of carbon coatings can be further improved by replacing the powder graphite form with layers of two-dimensional (2D) material, graphene [11-14]. Easy shear of 2D layers provides a unique set of characteristics needed for suppressing damage in mechanical contact [15-18]. Specifically, in the case of graphene platelets lubricating sliding steel counterparts, we observed a 4-5 times reduction in friction and 4 orders of magnitude reduction in wear [13, 14]. This improved performance was interchangeable when transitioning between humid and dry environments [12].

Dynamic processes that occur at the sliding interfaces create favorable high temperature and pressure conditions [7, 19] that may facilitate a chemical activity on the surface of sliding material, thus significantly reducing external temperature and energy supply need. These reactions are capable of forming very durable and self-generating boundary or surface films directly at the sliding contact [20, 21]. For example, the formation of DLC films on platinum-gold [22] surfaces was observed in a dry sliding environment with traces of organics. Tribologically-induced transformation of carbon-iron system during sliding in a dry environment, as it was shown in the case of iron nanoparticles, dispersed on the silicon substrate surface during sliding against DLC counterface, can facilitate the reconstruction of DLC amorphous carbon into onion-like carbon (OLC) structures[23].

Erdemir et al. [24, 25] have stated that the presence of catalytically active metals in the composite coating subjected to sliding in oil initiates the growth of DLC film in the wear track. This formed DLC significantly reduced the friction and wear of the sliding interfaces. Further, immersion of the Pt-containing [26] and Cu-containing [27] surfaces into alkanes during sliding resulted in in-situ generation of the carbon-based tribofilms with the structure and the growth rate of the films being determined by the nature of the catalytic materials and the sliding load and temperature conditions. Specifically, it was shown that the observed tribofilm growth rate can be fitted to an Arrhenius equation, indicating an increase in the film formation with applied load and higher temperature [26].

Notably, prior studies indicated the needs for tuning the coating composition dependent on the nature of the carbon precursor. Here, we design a new type of tribocatalytically-active coating, nickel-rich cobalt phosphorous film, using the electrodeposition process. The coating demonstrates great potential as wear-resistance material during sliding both in dry and lubricated hydrocarbon-rich environments. Our observations attribute the origin of excellent tribological characteristics to the tribocatalytically driven formation of layered carbon films from a hydrocarbon environment during sliding. Our results create the new possibilities for the design of the tribocatalytically-active coatings that demonstrate universality across liquid and gaseous hydrocarbon-rich environments.

Experimental Procedure

Deposition of the tribocatalytically active coatings. The coatings made of CoP matrix with the inclusion of active nickel elements were made using the electrodeposition process on 52100 steel. Different relative compositions of materials were analyzed to unravel the full potential of their tribocatalytic activity. The mirror-polished (~50 nm roughness) hardened (~60 HRC) 52100 steel substrates were cleaned with acetone prior to the deposition. To remove any grease or residue that remained on the surface, the deposition was preceded by anodic cleaning in a strong alkane solution. After cleaning the substrate was submerged in 10% $H_2SO_4$ diluted acid at room temperature to improve the adhesion of the coating. The deposition was performed in an electrolyte composed of a mixture of $CoCl_2$ (210 g/l), $NiCl_2$ (20 g/l), $H_3PO_4$ (50 g/l), Sodium hypophosphite (20 g/l), Sodium saccharin (1 g/l) using Pt electrode at 2-3V.~25 μm thickness of the resulting coating was controlled by the time of the deposition process.

Tribological tests. Tribological tests were performed using an Anton Paar pin-on-disk TRB$^3$ tribometer equipped with an enclosure for controlled environment tests. The uncoated 52100 steel and copper substrates purchased from McMaster Carr were used as baseline materials. To minimize the tribochemical activity at the counterface, all the tests were performed against alumina balls of 6 mm in diameter. The tests were performed at 50° C. in a reciprocating mode with a 1.4 mm stroke length at a 2 Hz frequency. The applied load and corresponding maximum contact pressure were in the range of 1-5 N (or maximum Hertzian pressure of 0.66-1.13 GPa). The tests were carried out using two different lubricants, Decane liquid lubricant and Ethanol vapor. In decane, the tests were performed by covering the samples with 150 cc of the lubricant. In case of the ethanol vapor tests, the nitrogen gas was flowing through the ethanol bath in the home-built experimental setup to reach full saturation of the chamber enclosure with the ethanol vapor. The relative pressure of ethanol vapor to the nitrogen gas was ~1:17.

Characterization. Chemical analysis and elemental mapping were performed using FEI Quanta 200 SEM equipped with energy-dispersive x-ray spectroscopy (EDS). Analysis of the wear tracks and ball wear marks was performed using a Zeiss optical microscope. Coating roughness and thickness analysis were performed using Veeco Dektak 150 stylus profilometer with a 2.5 μm tip radius. Raman characterization of the formed tribofilms was acquired using Renishaw Raman Spectrometer equipped with a green laser (532 nm wavelength).

Results and Discussion

Mirror-like coatings with 5-20 wt. % Ni with Ra~2 nm were co-electrodeposited by tuning the $Co^{+2}/Ni^{2+}$ ratio in the electrolyte through the setup schematically shown in FIG. 1*a*. In the absence of Ni ions, the CoP coating with 14 wt. % P was deposited, after introducing Ni ions with the range of 5-25 g/l, a series of CoNiP coatings with 3.3 to 13.8 Ni were deposited on the substrate (FIG. 1*b*). X-ray analysis of the deposited coatings reveals the amorphous structure of the films for pure CoP and CoNiP alloys. The film thickness was measured at 24.8 μm which is thick enough to reduce the effect of the substrate on the mechanical properties of the surfaces in contact. A uniform distribution of Ni and P across the film was detected in FIG. 1*g-i*.

To determine the optimum concentration of Ni in the coating to get the most promising protection on the surface, the coatings were tested in a decane environment. Decane presents one of the most promising low-viscosity fuels for next-generation high-efficiency combustion engines. Therefore, screening tribological experiments were conducted in decane at 1N load and at 50° C. temperature for 50 k cycles (FIG. 2). Uncoated AISI 52100 steel was used as the reference point since this alloy is the commonly used material in relevant industrial applications. The coefficient of friction of 52100 in a decane environment was measured to be 0.45; however, the average CoF for CoNiP alloys was considerably lower, around 0.12 (FIG. 2*a*). The optical micrographs of the wear tracks demonstrate the substantial difference between the wear of the heat-treated CoNiP and 52100 steel. The whole group of CoNiP has very similar wear rack width with the lowest width observed for the $Co_5NiP$ (wear track width of 80.3 μm being close to the Hertz contact size).

The 52100 steel substrate, on the other hand, has a wear track width of 448 μm (FIG. 2*d-i*). The wear rate shows a huge improvement after coating the surface with CoNiP. The best performance coating with 5% Ni has a wear rate of $2.18\times10^{7}$ $mm^3/N$ m, which is nearly three orders of magnitude lower than the 52100 steel with the wear rate of $2.038\times10\sim^{4}$ $mm^3/N$ m. Stylus profilometry results confirm the optical images. While the uncoated 52100 steel has a deep profile with a 7000 nm depth, all the members of the CoNiP group provide relatively shallow wear tracks with depths of about 250 nm. The interesting point of the profile analysis is finding a film on top of the wear track that is indicated by the positive values in FIG. 2*b*. The minimum profile depth with the greatest tendency for film formation on the wear track is related to $Co_5NiP$, which has the lowest wear rate as well. As a result, the $Co_5NiP$ was selected for further analysis to determine how different media and sliding conditions affect the tribocatalytic activity of protective film formation.

We further tested the performance of the $Co_5NiP$ coating at room temperature to understand its potential to sustain wear and improve frictional behavior. The frictional behavior summaries of the selected $Co_5NiP$ coating in decane and ethanol vapor are illustrated in FIG. 3 and FIG. 4, respectively. The $Co_5NiP$ coating shows relatively uniform and steady behavior as the load progresses within the 1-5 N range.

In decane, $Co_5NiP$ shows an average COF of 0.12 for a 1-5 N load (FIG. 3). To have a better understanding of the tribological performance of the $Co_5NiP$ coating, optical micrographs of the sliding interfaces after the tests were conducted. Upon increasing the load from 1 to 5 N, the wear track shows slight enlargement from 122.9 to 162.3 μm, respectively. The results of the stylus profilometry show a quite low depth of the wear tracks falling within the coating thickness (750 nm for 5 N of load). It should be noted, that the uncoated 52100 steel at 1N of load in decane, meanwhile, showed substantial nonuniformity of the worn surfaces around the edges of the wear track. The tribology results reveal good protection of the coated surface in decane media in contrast to the uncoated 52100 steel, even though the uncoated steel substrate has a two-times higher hardness than the coating.

To further unravel the universality of the $Co_5NiP$ coating for protecting the surfaces in carbon-rich environments, it was tested in a gaseous media. To eliminate the effect of humidity and residual oxygen, the system was first purged with $N_2$ for 10 minutes before introducing ethanol vapor into the chamber. Prior to the experiment, the system was purged with $N_2$-ethanol vapor for next 10 minutes to ensure a relatively uniform atmosphere within the chamber. The tribology analysis of the wear tracks is presented in FIG. 4. A frictional study reveals that $Co_5NiP$ has a low CoF for the tests conducted at 0.66-1.13 GPa maximum contact pressure range Increasing the load from 1N to 5N just increases the wear track width from 103.2 to 142.8 μm. Similarly to the tests in decane, $Co_5NiP$ tends to show positive profile areas at the edges of the wear track. This behavior could be due to the catalytically-induced tribofilm formation ability of the coating. To determine why this coating has such a low wear rate, further characterization was done on the wear track.

To unravel the nature of the formed tribofilms, we further characterized the wear tracks formed during sliding in decane and ethanol vapor environments. The micrographs (FIG. 5) of the wear track, along with the EDS elemental 2D mapping and 2D-Raman spectroscopy analyses, suggest that the origin of the excellent tribological characteristics is the in-situ formation of carbon-rich tribofilm formation on the $Co_5NiP$ coating. This formation is possible for both environments (decane and ethanol vapor). The traces of carbon on the wear track, with highest concentration accumulating at the edges of the wear tracks, are detectable by the EDS elemental mapping. Also, Raman spectroscopy revealed that the formed carbon-rich film has a mixture of D and G band figure prints, which show the formation of a-carbon as described in our previous study [27].

CONCLUSION

CoNiP coatings with 3-14 wt. % Ni incorporated in the CoP matrix were successfully deposited from a phosphoric electrolyte, and tribology experiments revealed that CoNiP with 5 wt. % of Ni demonstrated the optimal performance in decane environment. The resulting coefficient of friction was reduced 4 times when compared to the uncoated 52100 steel surfaces. The wear analysis showed also that the $Co_5NiP$ coating demonstrated almost three orders of magnitude reduction in wear rate than 52100 steel, $5.18\times10^{-7}$ for the coating in comparison to $2.038\times10^{4}$ $mm^3/N$ m for the uncoated steel. To demonstrate the adaptability of the coatings to the different hydrocarbon-rich environment, they were further tested in ethanol vapor and nitrogen gas mixture. The results indicated low and stable coefficient of friction and minimal wear of the surfaces. The formed wear tracks were analyzed with the elemental analysis and Raman spectroscopy indicating formation of the protective carbon-films inside the wear tracks. These carbon films are responsible for the improved friction and wear performance of the resulting materials.

REFERENCES

[1] R. Kurz, K. Brun, Degradation in gas turbine systems, J. Eng. Gas Turbines Power 123 (2000) 70-77.

[2] A. Greco, S. Sheng, J. Keller, A. Erdemir, Material wear and fatigue in wind turbine systems, Wear 302 (2013) 1583-1591.

[3] E. R. Booser, Tribology data handbook: an excellent friction, lubrication, and wear resource, CRC press1997.

[4] S.-T. Buljan, S. F. Wayne, Wear and design of ceramic cutting tool materials, Wear 133 (1989) 309-321.

[5] E. J. Breton, J. M. Handzel, O. K. Tennant, Process for making wear-resistant coatings, Google Patents, 2003.

[6] S. J. Mroczkowski, Multi-layer wear resistant coatings, Google Patents, 1990.

[7] M. F. Ashby, J. Abulawi, H. S. Kong, Temperature Maps for Frictional Heating in Dry Sliding, Tribology Transactions 34 (1991) 577-587.

[8] T. D. B. Jacobs, R. W. Carpick, Nanoscale wear as a stress-assisted chemical reaction, Nat Nano 8 (2013) 108-112.

[9] Y. Junbin, D. Junxiu, Tribocatalysis reaction during antiwear synergism between borates and Sn(IV) compounds in boundary lubrication, Tribology International 29 (1996) 429-432.

[10] T. Onodera, K. Kawasaki, T. Nakakawaji, Y. Higuchi, N. Ozawa, K. Kurihara, M. Kubo, Tribocatalytic Reaction of Polytetrafluoroethylene Sliding on an Aluminum Surface, The Journal of Physical Chemistry C 119 (2015) 15954-15962.

[11] D. Berman, A. Erdemir, A. V. Sumant, Graphene as a protective coating and superior lubricant for electrical contacts, Appl. Phys. Lett. 105 (2014) 231907.

[12] D. Berman, S. A. Deshmukh, S. K. R. S. Sankaranarayanan, A. Erdemir, A. V. Sumant, Extraordinary Macroscale Wear Resistance of One Atom Thick Graphene Layer, Adv. Funct. Mater. 24 (2014) 6640-6646.

[13] D. Berman, A. Erdemir, A. V. Sumant, Reduced wear and friction enabled by graphene layers on sliding steel surfaces in dry nitrogen, Carbon 59 (2013) 167-175.

[14] D. Berman, A. Erdemir, A. V. Sumant, Few layer graphene to reduce wear and friction on sliding steel surfaces, Carbon 54 (2013) 454-459.

[15] C. Soldano, A. Mahmood, E. Dujardin, Production, properties and potential of graphene, Carbon 48 (2010) 2127-2150.

[16] D. Prasai, J. C. Tuberquia, R. R. Harl, G. K. Jennings, K. I. Bolotin, Graphene: Corrosion-Inhibiting Coating, ACS Nano 6 (2012) 1102-1108.

[17] C. Lee, X. Wei, J. W. Kysar, J. Hone, Measurement of the Elastic Properties and Intrinsic Strength of Monolayer Graphene, Science 321 (2008) 385-388.

[18] G.-H. Lee, R. C. Cooper, S. J. An, S. Lee, A. van der Zande, N. Petrone, A. G. Hammerberg, C. Lee, B. Crawford, W. Oliver, J. W. Kysar, J. Hone, High-Strength Chemical-Vapor-Deposited Graphene and Grain Boundaries, Science 340 (2013) 1073-1076.

[19] Q. Chen, D. Li, A computational study of frictional heating and energy conversion during sliding processes, Wear 259 (2005) 1382-1391.

[20] C. Kajdas, K. Hiratsuka, Tribochemistry, tribocatalysis, and the negative-ion-radical action mechanism, Proceedings of the Institution of Mechanical Engineers, Part J: Journal of Engineering Tribology 223 (2009) 827-848.

[21] P. Ren, K. Zhang, X. He, S. Du, X. Yang, T. An, M. Wen, W. Zheng, Toughness enhancement and tribochemistry of the Nb—Ag—N films actuated by solute Ag, Acta Mater. 137 (2017) 1-11.

[22] N. Argibay, T. F. Babuska, J. F. Curry, M. T. Dugger, P. Lu, D. P. Adams, B. L. Nation, B. L. Doyle, M. Pham, A. Pimentel, C. Mowry, A. R. Hinkle, M. Chandross, In-situ tribochemical formation of self-lubricating diamond-like carbon films, Carbon 138 (2018) 61-68.

[23] D. Berman, K. C. Mutyala, S. Srinivasan, S. K. R. S. Sankaranarayanan, A. Erdemir, E. V. Shevchenko, A. V. Sumant, Iron-Nanoparticle Driven Tribochemistry Leading to Superlubric Sliding Interfaces, Advanced Materials Interfaces 6 (2019) 1901416.

[24] A. Erdemir, G. Ramirez, O. L. Eryilmaz, B. Narayanan, Y. Liao, G. Kamath, S. K. R. S. Sankaranarayanan, Carbon-based tribofilms from lubricating oils, Nature 536 (2016) 67-71.

[25] A. Erdemir, G. Ramirez, O. L. Eryilmaz, B. Narayanan, Y. Liao, K. Ganesh, S. K. R. S. Sankaranarayanan, Carbon-based tribofilms from lubricating oils, Nature 536 (2016) 67-71.

[26] A. Shirani, Y. Li, J. Smith, J. Curry, P. Lu, M. Wilson, M. Chandross, N. Argibay, D. Berman, Mechanochemically driven formation of protective carbon films from ethanol environment, Materials Today Chemistry 26 (2022) 101112.

[27] A. Shirani, Y. Li, O. L. Eryilmaz, D. Berman, Tribocatalytically-activated formation of protective friction and wear reducing carbon coatings from alkane environment, Scientific Reports 11 (2021) 20643.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, "about 0" can refer to 0, 0.001, 0.01, or 0.1. In an embodiment, the term "about" can include traditional rounding according to significant figures of the numerical value. In addition, the phrase "about 'x' to 'y'" includes "about 'x' to about 'y'".

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

The invention claimed is:

1. A coated structure, comprising a surface of the structure having a tribocatalytically-active coating disposed on the surface, wherein the tribocatalytically-active coating comprises a matrix having at least one type of catalytically active element, wherein the matrix is a CoP matrix or a NiP matrix, wherein the catalytically active element is a nanoparticle having a longest dimension of about 3 to 10 nanometers, wherein the catalytically active element is about 5 to 30 weight percent of the tribocatalytically-active coating.

2. The coated structure of claim 1, wherein the type of catalytically active element is selected from Ni, Cu, Ir, Pt, Pd, Ru, and Mo.

3. The coated structure of claim 1, wherein the type of catalytically active element is Ni.

4. The coated structure of claim 1, wherein the structure is made of steel, copper, aluminum, stainless steel, or bronze.

5. The coated structure of claim 1, wherein the tribocatalytically-active coating has a thickness of about 1 to 25 micrometers.

6. The coated structure of claim 1, wherein the surface of the structure having the tribocatalytically-active coating has a Coefficient of friction of about 0.1 to 0.15 in decane and 0.1-0.2 in ethanol vapor.

7. The coated structure of claim 1, further comprising a hydrocarbon-rich material in contact with the tribocatalytically-active coating, wherein the hydrocarbon-rich material is a hydrocarbon in a liquid state or in a gaseous state.

8. A coated structure, comprising a surface of the structure having a tribocatalytically-active coating disposed on the surface, wherein the tribocatalytically-active coating comprises a matrix having at least one type of catalytically active element, wherein the matrix is a CoP matrix or a NiP matrix, wherein the catalytically active element is a nanoparticle having a longest dimension of about 3 to 10 nanometers, wherein a hydrocarbon-rich material in contact with the tribocatalytically-active coating, wherein the hydrocarbon-rich material is a hydrocarbon in a liquid state.

9. The coated structure of claim 1, wherein the catalytically active element is about 5 to 30 weight percent of the tribocatalytically-active coating.

10. The method of claim 8, wherein the type of catalytically active element is selected from Ni, Cu, Ir, Pt, Pd, Ru, and Mo.

11. A coated structure, comprising a surface of the structure having a tribocatalytically-active coating disposed on the surface, wherein the tribocatalytically-active coating comprises a matrix having at least one type of catalytically active element, wherein the matrix is a CoP matrix or a NiP matrix, wherein the catalytically active element is a nanoparticle having a longest dimension of about 3 to 10 nanometers, wherein a hydrocarbon-rich material in contact with the tribocatalytically-active coating, wherein the hydrocarbon-rich material is a hydrocarbon in a gaseous state.

12. The coated structure of claim 11, wherein the catalytically active element is about 5 to 30 weight percent of the tribocatalytically-active coating.

13. A method of making the coated structure, comprising:

introducing an uncoated structure having a surface to an electrolyte including a mixture of metal-based material, a phosphorus based-material, and a catalytically active element based-material, wherein the metal-based material is a cobalt-based material selected from $CoCl_2$ or $CoSO_4$, wherein the phosphorus-based material is $H_3PO_4$ or $NaH_2PO_2$; and forming a tribocatalytically-active coating on the surface by electrodeposition of the mixture, wherein the tribocatalytically-active coating comprises a matrix having at least one type of catalytically active element, wherein the matrix is a COP matrix, wherein the catalytically active element is a nanoparticle having a longest dimension of about 3 to 10 nanometers.

14. The method of claim 13, wherein the catalytically active element-based material is a Ni catalytically active element-based material, Cu catalytically active element-based material, Ir catalytically active element-based material, Pt catalytically active element-based material, Pd catalytically active element-based material, Ru catalytically active element-base, and Mo catalytically active element-base.

15. The method of claim 13, wherein the uncoated structure is made of steel, copper, aluminum, stainless steel, or bronze.

16. A method of making the coated structure, comprising:

introducing an uncoated structure having a surface to an electrolyte including a mixture of metal-based material, a phosphorous based-material, and a catalytically active element based-material, wherein the metal-based material is a cobalt-based material or a nickel-based material; and forming a tribocatalytically-active coating on the surface by electrodeposition of the mixture, wherein the tribocatalytically-active coating comprises a matrix having at least one type of catalytically active element, wherein the matrix is a CoP matrix or a NiP matrix, wherein the catalytically active element is a nanoparticle having a longest dimension of about 3 to 10 nanometers, wherein the type of catalytically active element is selected from Ni, Cu, Ir, Pt, Pd, Ru, and Mo wherein the catalytically active element is about 5 to 30 weight percent of the tribocatalytically-active coating.

17. The method of claim 16, when the matrix is a CoP matrix, the metal-based material is a cobalt-based material selected from $CoCl_2$ or $CoSO_4$, and wherein the phosphorus based material is $H_3PO_4$ or $NaH_2PO_2$.

18. The method of claim 16, when the matrix is a NiP matrix, the metal-based material is a nickel-based material selected from $NiCl_2$ or $NiSO_4$, and wherein the phosphorus based material is $H_3PO_4$ or $NaH_2PO_2$.

19. The method of claim 16, wherein the type of catalytically active element is Ni.

* * * * *